United States Patent [19]

Rubenzer et al.

[11] Patent Number: 4,779,769

[45] Date of Patent: Oct. 25, 1988

[54] DISPENSING DEVICE FOR LIQUIDS

[75] Inventors: Peter Rubenzer; Eike Böhme, both of Salzburg, Austria

[73] Assignee: Prolic S.A., Luxemburg, Luxembourg

[21] Appl. No.: 113,345

[22] Filed: Oct. 26, 1987

Related U.S. Application Data

[63] Continuation of Ser. No. 815,087, filed as PCT EP85/00154 on Apr. 4, 1985, published as W085/04599 on Oct. 24, 1985, abandoned.

[30] Foreign Application Priority Data

Apr. 10, 1984 [AT] Austria ..... 1196/84

[51] Int. Cl.[4] ..... B67D 5/00

[52] U.S. Cl. ..... 222/330; 222/478; 137/593

[58] Field of Search ..... 222/330, 478, 481–482, 222/484–486, 420; 138/30; 137/593; 141/236, 237; 422/100, 103

[56] References Cited

U.S. PATENT DOCUMENTS

| | | | |
|---|---|---|---|
| 3,357,606 | 12/1967 | Kahlenberg . | |
| 3,724,984 | 4/1973 | Jernigan | 222/330 |
| 3,771,366 | 11/1973 | Thulin . | |
| 3,818,931 | 6/1972 | Carpenter | 137/593 |
| 4,488,665 | 12/1984 | Cocks et al. | 222/482 |

FOREIGN PATENT DOCUMENTS 1556997 2/1969 France .

*Primary Examiner*—H. Grant Skaggs
*Attorney, Agent, or Firm*—Wenderoth, Lind & Ponack

[57] ABSTRACT

A dispensing device enables a liquid to be delivered to the cavities of a titration plate. In order to obtain optimum quality of delivery, charging pipes lead from a distributing pipe first upwards, and then, after passing a bypass area, downwards to a discharge area.

5 Claims, 1 Drawing Sheet

DISPENSING DEVICE FOR LIQUIDS

This application is a continuation of now abandoned application Ser. No. 815,087, filed as PCT EP85/00154 on Apr. 4, 1985 published as PCT EP85/00154 on Apr. 4, 1985 published as WO85/04599 on Oct. 24, 1985.

BACKGROUND OF THE INVENTION

The present invention relates to a dispensing device for liquids, more particularly for filling up cavities of titration plates, with a distributing pipe connected via piping to a pump and from which extend radially at least two, preferably eight, charging pipes.

Medical laboratory technology makes use of the Elisa (Enzyme Linked ImmunoSorbent Assay) method or the various processes of this system, for instance for measuring antigens and/or antibodies. As an example, to measure antigens in a first process step, antibodies are absorbed on the titration plate, the titration plate is then washed, whereupon in a further process step a residual solution containing the antigen is added. This is followed by another washing, after which enzyme-marked specific antibodies are added to the titration plate, again followed by washing on the titration plate and addition of the enzyme substrate.

The actual measuring is effected by means of a photometer.

The microtitration plates currently in use comprise 96 cavities, each one of which corresponds practically to a cuvette.

The dispensing devices of known construction are capable of filling up eight cavities at a time.

One of the main problems encountered is the fact that the charge must be as constant as possible for each cavity and further that both the formation of air bubbles and post-dripping must be prevented with the highest degree of assurance.

The uniform delivery problem is rendered more difficult by the fact that one and the same device must be able to deliver liquids with different viscosities in different test operations.

With the conventional variable-stroke piston pump or membrane pump, a delivery equalization accurate to 5% is achieved. This is to be significantly improved by the invention.

SUMMARY OF THE INVENTION

This object is achieved according to the invention by leading the charging pipes first upwards from the distributing pipe an then, after passing a bypass area, downwards to a discharge area.

In this connection, it should be noted that what is of importance is, not the total quantity of liquid charged in a titration plate and the volume fluctuations thereof, but the volume ratio of the liquids in the individual cavities to one another.

Conventional variable-stroke piston pumps deliver a quantity of 0.4 ml per pumping cycle so that, in the case of a dispensing device with eight charging pipes, 50 μl of test liquid are delivered to each cavity in the microtitration plate. It has been found to be advantageous for the accuracy of delivery to form the piping between the distributing pipe and the pump from elastic material in order to some extent to compensate for the relatively severe impacts caused by the pump. It should also be pointed out that in the dispensing device embodying the invention, at the end of each pumping operation the liquid in the charging pipes is drawn back approximately 1–2 mm, thereby preventing with assurance any post-dripping.

The device incorporating the invention achieves only approximately 1%-volume differences in the cavity fillings.

One embodiment of the invention provides for bypass areas of the charging pipes that are rectilinear horizontally.

A particularly advantageous embodiment of the invention is characterized by the fact that at a position above the distributing pipe there is provided a compensating pipe aligned parallel to the distributing pipe and to which the bypass portions of the charging pipes are connected with two connecting pipes or passages provided between the distributing pipe and the compensating pipe and eight charging pipe portions extending from the compensation pipe.

Advantageously, the discharge areas of the charging pipes are formed of metal pipe elements.

According to another embodiment, the distributing pipe, the upwardly extending connecting pipes, the bypass portions of the charging pipes and, optionally, the compensating pipe are incorporated into a common block in which the pipe elements are supported. The block may be made of plastic or high-grade steel.

Advantageously, the block is made in two parts, with the separation plane between the block portions being equal to a section through the pipes.

Advantageously, the block is provided with a lower holding strip for the pipe elements.

BRIEF DESCRIPTION OF THE DRAWINGS

One embodiment of the invention will be described below with reference to the accompanying drawings, wherein.

DETAILED DESCRIPTION OF THE INVENTION

Figure 1:
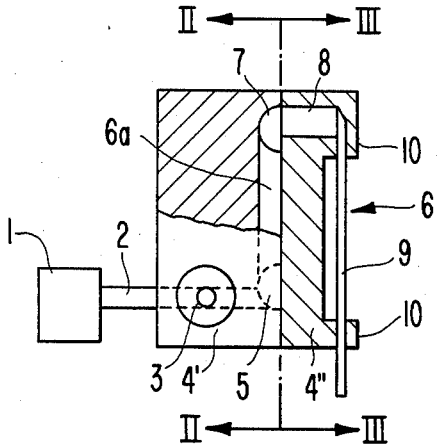
FIG. 1 is a section through a device of the invention
Figure 2:
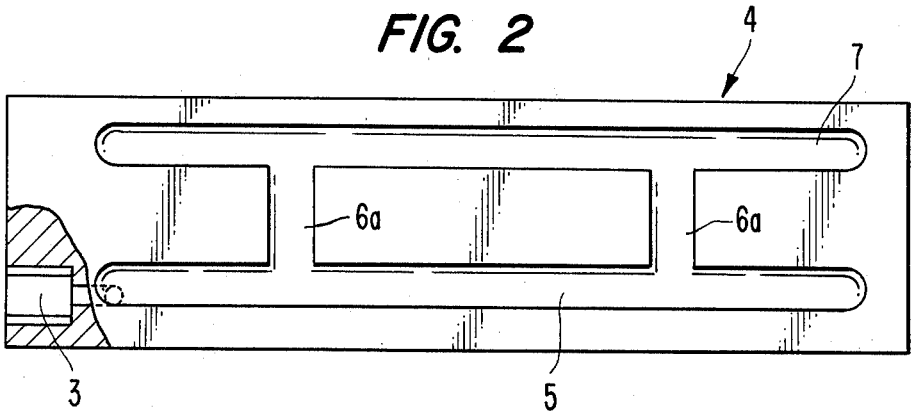
FIG. 2 is a section taken along line III—III of FIG. 1.
Figure 3:
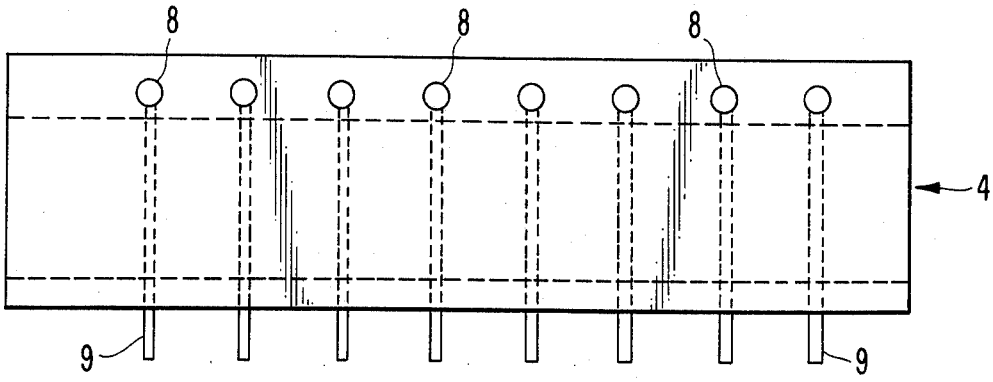
FIG. 3 is a section taken along line IV—IV of FIG. 2.

The remaining parts of the dispensing device, such as pump, control device and liquid tank are not shown in detail in the drawings, since they form part of the conventional state of the art.

From a pump 1 a piping 2 leads to a connection 3 in a block 4 according to the invention and liquid is conducted therein first to a horizontally aligned distributing pipe or passage 5.

In the embodiment shown, two connecting passages **6*a* in the block 4 lead upwards from the distributiing pipe 5 to a compensation pipe or passage 7**.

Eight charging pipes 6 lead away from the compensation pipe 7, first with horizontal bypass portions 8 and, finally, with vertically extending discharge portions 9.

As is apparent from FIG. 1, the bypass portions 8 are incorporated into the block 4. In the embodiment shown, the discharge portions 9 of the charging pipes 6 are formed of separate pipe elements.

As can be seen in FIG. 1, the block 4 is made in two parts, with the distributing pipe 5, the compensation pipe 7 and the two upwardly extending connecting passages **6*a* being formed as recesses in a surface of one part 4', while a second part 4'' contains the horizontal bypass portions 8 of the charging pipes 6. The pipe elements forming the discharge portions 9 also extend into the second part 4'' of the block 4, which is equipped at the top and at the bottom with holding strips 10** for supporting the pipe elements.

It should further be pointed out that the pipe elements in the embodiment shown have a diameter of 0.6 mm and a length of 21 mm. The velocity of the liquid in the pipe elements is approximately 0.7 m/sec.

What is claimed is:

1. A liquid dispensing device, particularly for filling liquid into cavities of titration plates, said device comprising:

a lower pipe-like, elongated distributing passage to be connected to a pump for supplying liquid to said distributing passage;

a pipe-like, elongated compensation passage having a length substantially equal to the length of said distributing passage and located vertically above said distributing passage and extending parallel thereto;

at least two connecting passages extending upwardly from said distributing passage to said compensation passage; and a plurality, greater than the number of said connecting passages, of charging pipes extending from said compensation passage, each said charging pipe including a first portion extending substantially horizontally from said compensation passage and a second portion extending downwardly from the respective said first portion.

2. A device as claimed in claim 1, further comprising a block formed by two abutting parts, said distributing passage, said compensation passage, and said connecting passages being formed in a first said part, said first portions of said charging pipes being formed in a second said part and said second portions of said charging pipes extending into said second part.

3. A device as claimed in claim 2, wherein said distributing passage, said compensation passage and said connecting passages comprise recesses formed in a surface of said first part.

4. A device as claimed in claim 2, wherein said second portions of said charging pipes comprise pipe elements.

5. A device as claimed in claim 4, further comprising at least one holding means for supporting said pipe elements on said second part.

* * * * *